US006311707B1

(12) United States Patent
Wu et al.

(10) Patent No.: US 6,311,707 B1
(45) Date of Patent: Nov. 6, 2001

(54) UMBRELLA

(76) Inventors: Chieh-Chih Wu; Ching-Tsai Chen; Chen-Maan Chang, all of No, 380, Lun Mei Rd., Chang Hwa (TW)

( * ) Notice: Subject to any disclaimer, the term of this patent is extended or adjusted under 35 U.S.C. 154(b) by 0 days.

(21) Appl. No.: 09/604,517

(22) Filed: Jun. 27, 2000

(30) Foreign Application Priority Data

Oct. 8, 1999 (TW) ..... 88216825 U

(51) Int. Cl.[7] ..... A45B 25/14

(52) U.S. Cl. ..... 135/28; 135/29; 135/23; 135/31; 135/39; 135/15.1

(58) Field of Search ..... 135/31, 28, 29, 135/39, 40, 41, 15.1, 19.5, 23

(56) References Cited

U.S. PATENT DOCUMENTS 334,588 * 1/1886 Jones ..... 135/31
360,294 * 3/1887 Haitz ..... 135/31
952,630 * 3/1910 Philip ..... 135/28
1,513,655 * 10/1924 Turner ..... 135/28
3,565,087 * 2/1971 Arai ..... 135/23
5,050,627 * 9/1991 Hengtzu ..... 135/23
5,329,953 * 7/1994 Becher ..... 135/31

* cited by examiner

*Primary Examiner*—Robert Canfield
(74) *Attorney, Agent, or Firm*—Rosenberg, Klein & Lee

(57) ABSTRACT

An umbrella includes a shaft having a plurality of ribs radially and pivotally connected to a finishing cap on the top of the shaft and a sleeve is slidably mounted to the shaft. A stop, a first flange and a second flange respectively extend radially outward from the sleeve, wherein the first flange is located between the stop and the second flange. A collar is movably mounted to the sleeve and located between the stop and the first flange. A plurality of first stretchers pivotally connected between the collar and the ribs. A runner is movably mounted to the sleeve and located between the first flange and the second flange. A plurality of second stretchers are pivotally connected between the runner and the ribs. The sleeve is pushed toward the collar to move the collar and to let the panel be expanded by the first stretchers and the movement of the ribs expand the second stretchers.

5 Claims, 8 Drawing Sheets

UMBRELLA

FIELD OF THE INVENTION

The present invention relates to an umbrella, and more particularly, to an improved umbrella which has two sets of stretchers connected to the ribs and a sleeve slidably mounted to the shaft of the umbrella so that the umbrella is easily to be expanded.

BACKGROUND OF THE INVENTION

A conventional umbrella as shown in FIG. 9 generally includes a shaft 40 having a finishing cap 41 on a top end thereof and a handle 400 on a lower end of the shaft 40. A plurality of ribs 31 pivotally connected to the finishing cap 41 and a panel is connected to the tip end of each rib 31. A runner 42 is movably mounted to the shaft 40 and a plurality of stretchers 32 are pivotally connected between the runner 42 and the ribs 31. When expanding the umbrella, the user pushes the runner 42 along the shaft 40 till the runner 42 is stopped by a top spring on the shaft 40. The stretchers 32 push the ribs 31 to expand the panel when the runner 42 is stopped by the top spring. When folding the umbrella, the runner 42 is pulled downward to pivot the stretchers and stopped by the lower spring on the shaft 40. The ribs 31 are folded about the finishing cap 41 and the panel is folded. The user has to take a hard effort to overcome the resistant force of the stretchers and the ribs when expand the umbrella. When the umbrella is folded, the runner 42 will move rapidly when the top spring is compressed, and this actions often hurt the user's hand.

The present invention intends to provide an umbrella having a sleeve mounted to the shaft and a runner mounted to the sleeve, the runner is moved by the movement of the sleeve which is operated by the user. The distance that the sleeve is moved is short and convenient so that the user's hand does not necessary hold the runner and move for a long distance when expanding and folding the umbrella. The umbrella improves the disadvantages of the conventional umbrella.

SUMMARY OF THE INVENTION

In accordance with one aspect of the present invention, there is provided an umbrella comprising a shaft having a finishing cap on a first end thereof and a handle on a second end of the shaft. A plurality of ribs are radially and pivotally connected to the finishing cap. A sleeve is slidably mounted to the shaft with a stop extending radially outward from a first end of the sleeve 21, and a first flange and a second flange respectively extending radially outward from the sleeve. The first flange is located between the stop and the second flange. A collar is movably mounted to the sleeve and located between the stop and the first flange. A plurality of first stretchers are pivotally connected between the collar and the ribs. A runner is movably mounted to the sleeve and located between the first flange and the second flange. A plurality of second stretchers are pivotally connected between the runner and the ribs.

The object of the umbrella of present invention is to provide an improved structure comprising two sets of stretchers respectively pivotally connected to a collar and a runner both of which are slidably mounted to a sleeve mounted on the shaft of the umbrella. By the two sets of stretchers, the umbrella is easily to expand.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
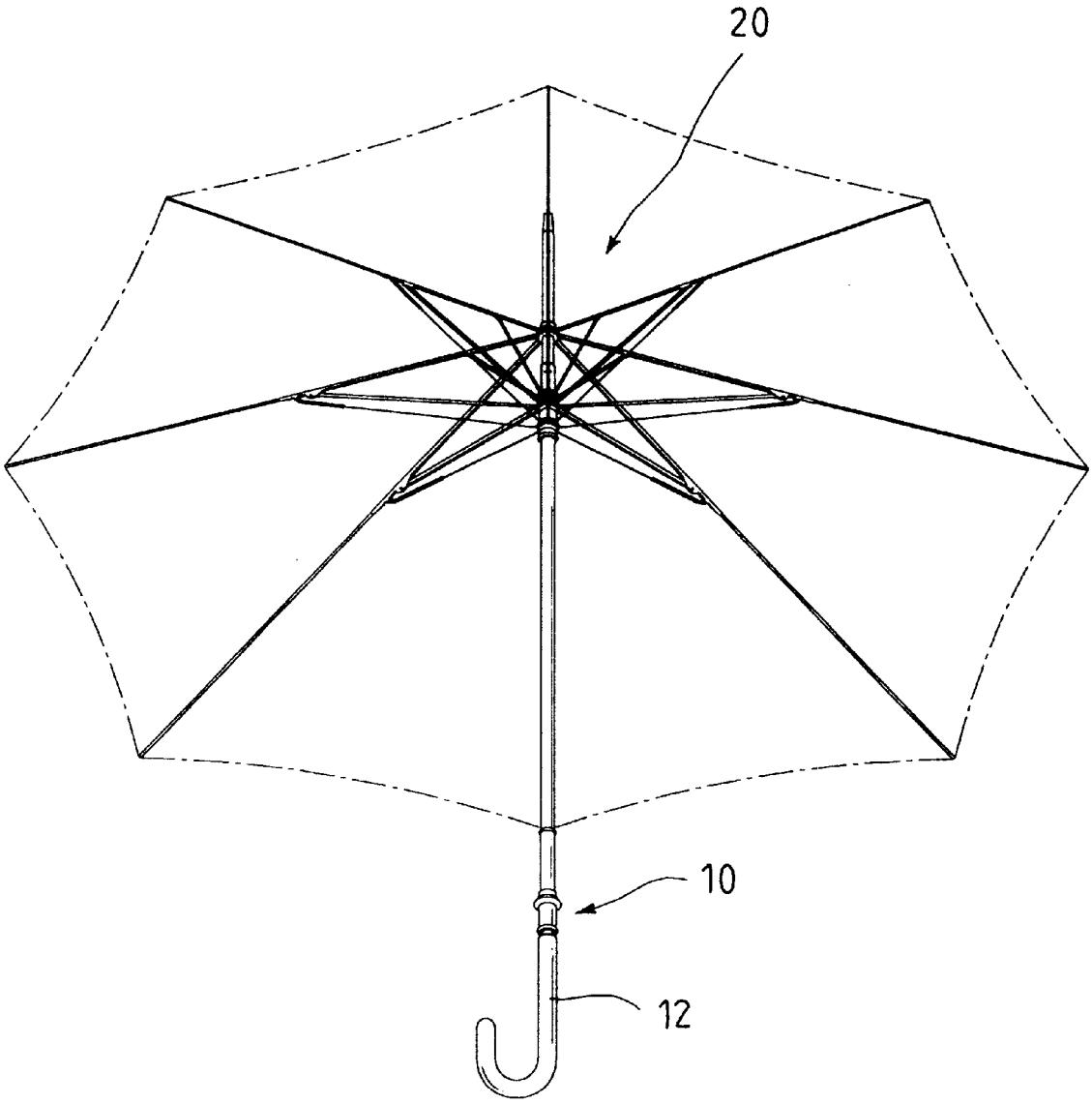
FIG. 1 is a perspective view form the bottom of the umbrella of the present invention.
Figure 2:
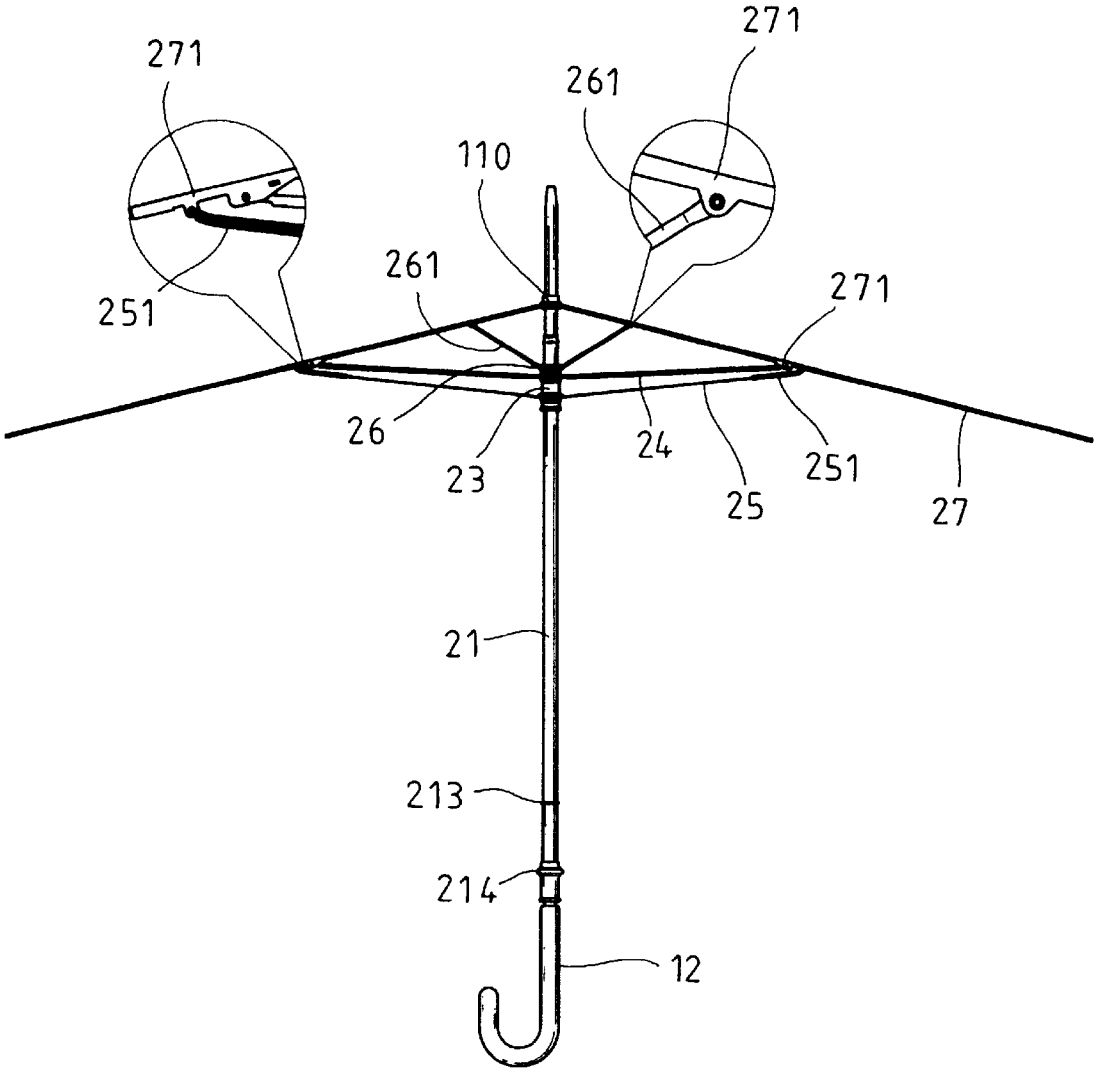
FIG. 2 is a side illustration view to show the umbrella when the umbrella is expanded.
Figure 3:
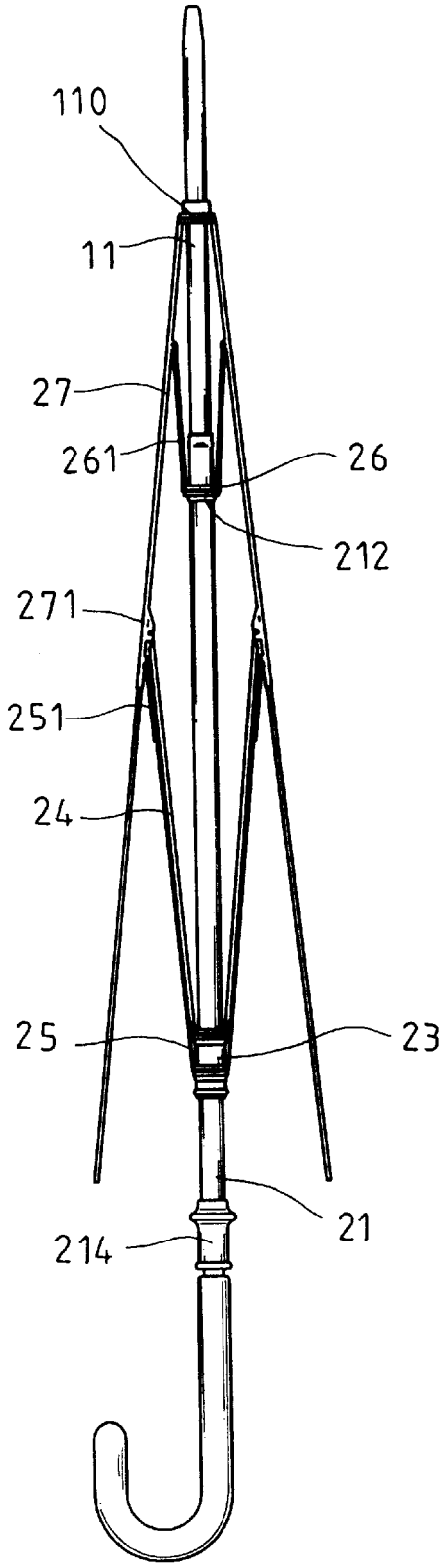
FIG. 3 is a side elevational view to show the two sets of the stretchers when the umbrella is folded.
Figure 4:
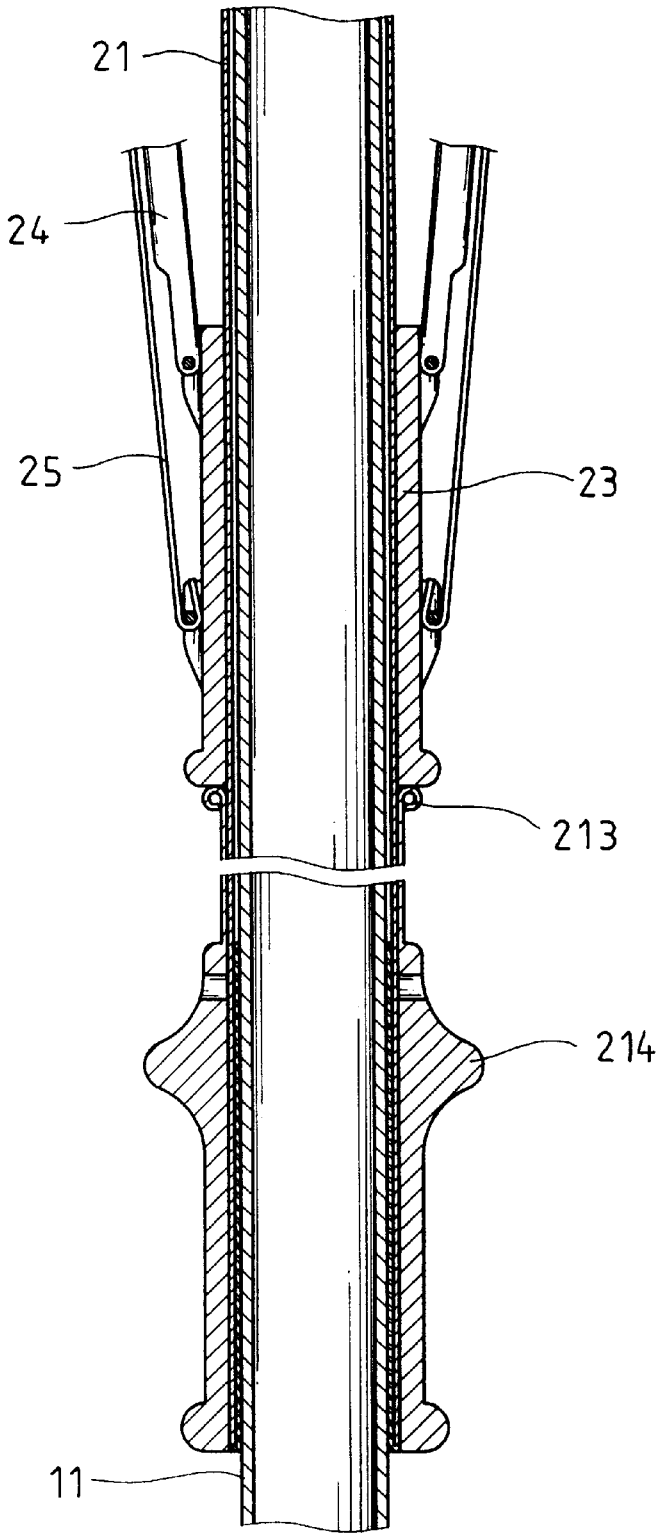
FIG. 4 is a side elevational view, partly in section, of the runner on the sleeve when the umbrella is folded.
Figure 5:
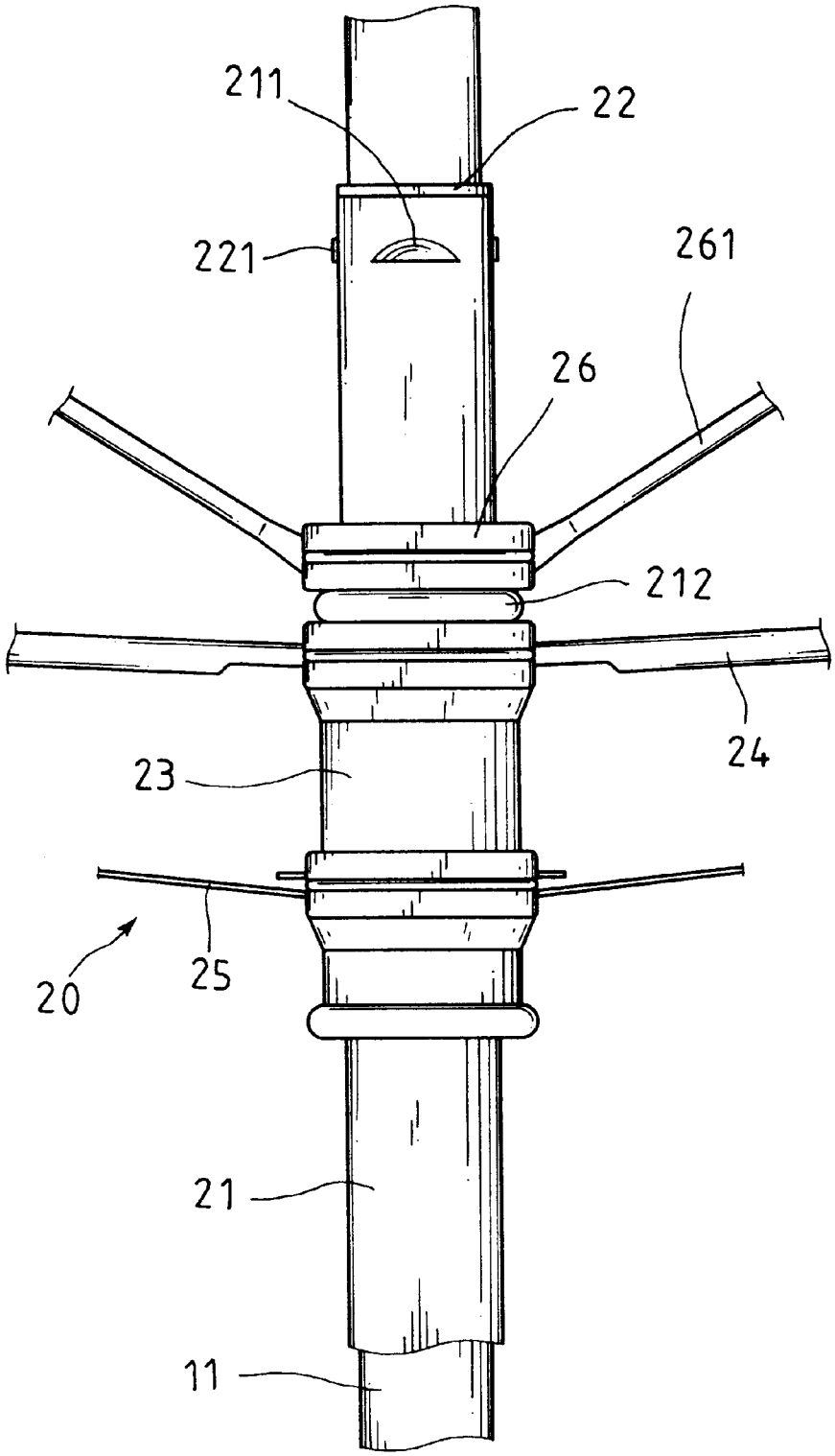
FIG. 5 is a side elevational view, partly in section, of the collar on the sleeve when the umbrella is to be folded and the collar is stopped by the first flange.
Figure 6A:
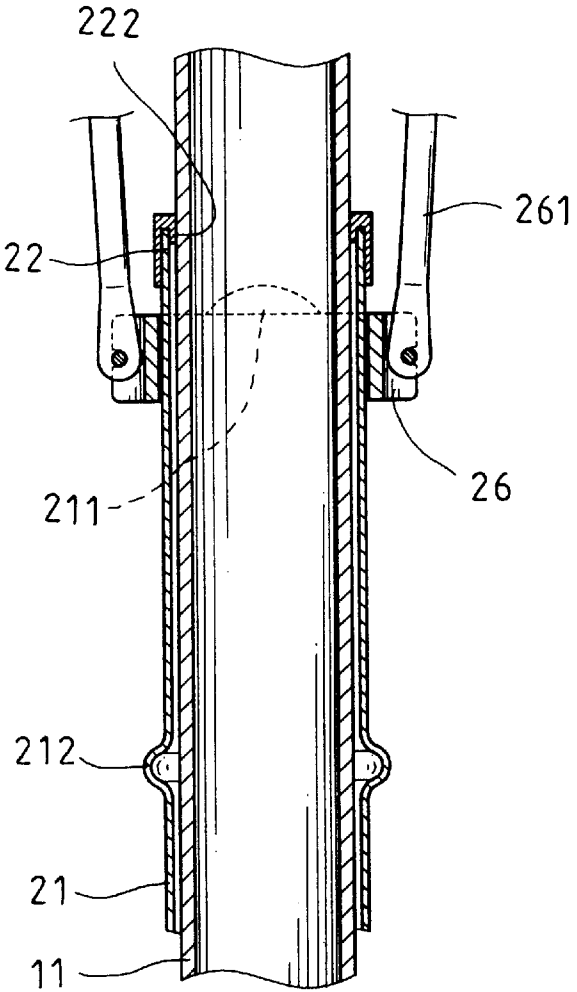
FIG. 6A is a cross sectional view to show the umbrella in the status as shown in FIG. 6.

Referring to FIGS. 1 to 5, the umbrella in accordance with the present invention comprises a shaft 11 having a finishing cap 110 on a first end thereof and a handle 12 on a second end of the shaft 11. A plurality of ribs 27 are radially and pivotally connected to the finishing cap 110. A panel 20 is securely mounted to the ribs 27 and is fixed to the tip of each of the ribs 27. A sleeve 21 is slidably mounted to the shaft 11 with a positioning cap 22 (FIG. 6A) connected to a first end of the sleeve 21 and the positioning cap 22 has an annular tongue portion 222 which is located between the sleeve 21 and the shaft 11. An actuator 214 is connected to a second end of the sleeve 21. A plurality of stops 211 (only one is shown) extend radially outward from the first end of the sleeve 21 and a first flange 212 extends radially outward from the sleeve 21 and is located below the stops 211. A second flange 213 extends radially outward from the second end of the sleeve 21 and is close to the actuator 214. The first flange 212 located between the stops 211 and the second flange 213. A collar 26 movably mounted to the sleeve 21 and is located between the stops 211 and the first flange 212. A plurality of first stretchers 261 are pivotally connected between the collar 26 and protrusions 271 of the ribs 27 as shown in FIG. 2. As illustrated in FIGS. 3 and 5, a runner 23 is movably mounted to the sleeve 21 and located between the first flange 212 and the second flange 213. A plurality of second stretchers 24 and a plurality of resilient members 25 are respectively connected between the runner 23 and the protrusions 271 of the ribs 27. Each resilient member 25 is connected to a spring 251 which is connected between the protrusion 271 and the resilient member 25. It is to be noted that a distance between the first flange 212 and the second flange 213 is larger than a distance between the first flange 212 and the stops 211.

When the umbrella is folded, the first stretchers 261 and the second stretchers 24 are folded toward the sleeve 21, and the collar 26 contacts the stops 211 as shown in FIGS. 3 to 5. When a user wants to expand the umbrella, he/she simply pushes the actuator 214 toward the runner 23, and the sleeve 21 moves and the first flange 212 pushes the collar 26 to let the first stretchers 261 be pivoted and expand to stretch the panel 20 outward. When the panel 20 is expanded by the first stretchers 261, the radial movement of the ribs 27 pull the second stretchers 24 and the resilient members 25 to expand so that the umbrella is easily to be expanded. It is easily and saves effort because the collar 26 moves only a short distance and the first stretchers 261 will assist the expansion of the panel 20 together with the ribs 27 so that the runner 23 is easily to be shifted to contact the first flange 212 to fully open the umbrella.

Figure 6:
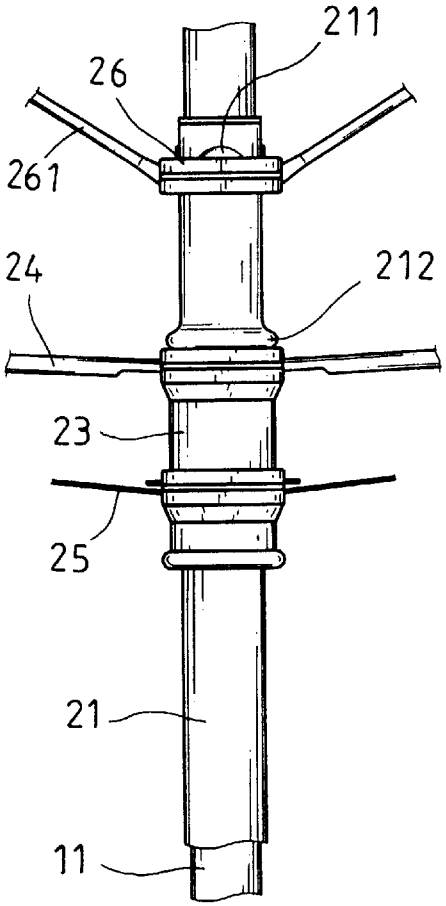
FIG. 6 is a side elevational view, partly in section, of the collar on the sleeve when the umbrella is to be folded and the collar is pushed by the downward movement of the stop.
Figure 8:
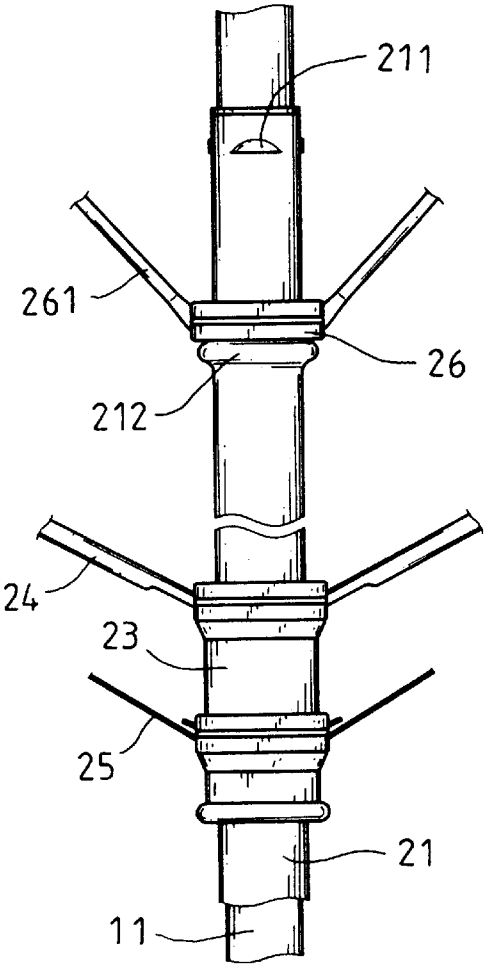
FIG. 8 shows that the collar is moved to a position contacting the first flange.
Figure 7:
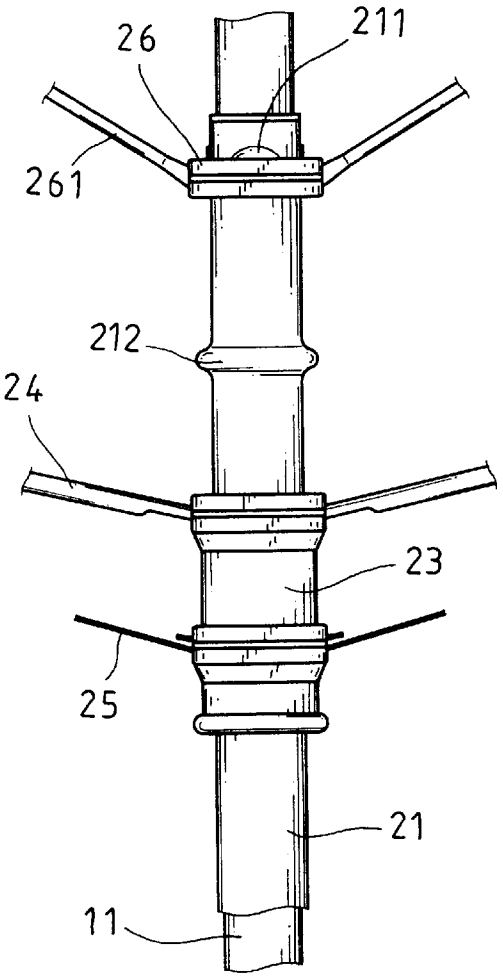
FIG. 7 shows that when the umbrella is to be folded, the sleeve is moved downward and the collar is moved downward with the sleeve.
Figure 9:
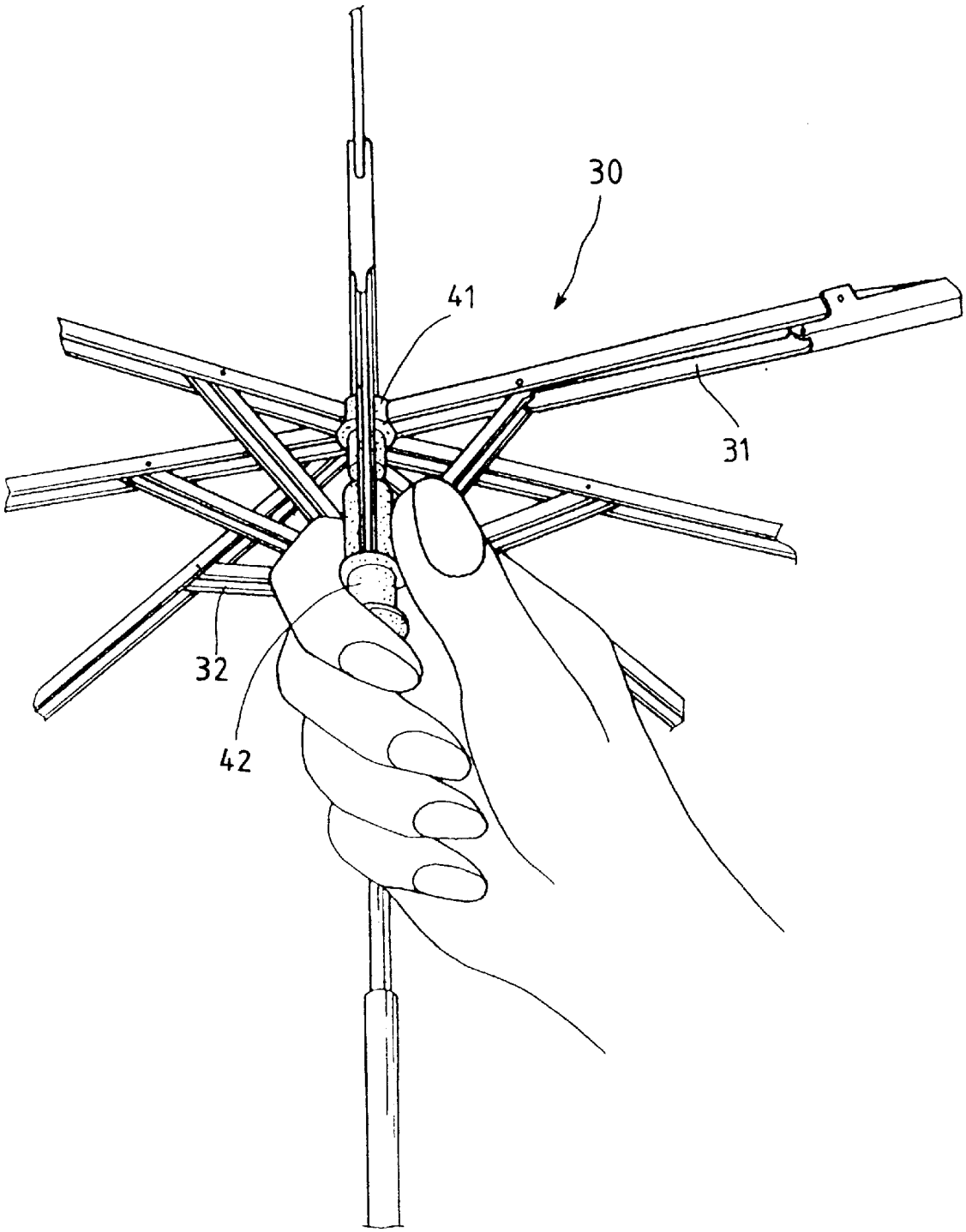
FIG.9 PRIOR ART
FIG. 9 is an illustrative view to show a runner of a conventional umbrella.

When folding the umbrella, as shown in FIGS. 6 to 8, the user pulls the actuator 214 toward the handle 12 and the sleeve 11 is moved downward, the stops 211 on the sleeve 21 push the collar 26 toward the first flange 212 so that the first stretchers 261 quickly collapse by the assistance of the force of the springs 251 so that the folding actions of the umbrella is effort saving and easily.

Accordingly, the two sets of stretchers 261, 24 reduces the effort needed to expand the umbrella and the springs 251 make the folding action be easier than the conventional umbrella.

While we have shown and described various embodiments in accordance with the present invention, it should be clear to those skilled in the art that further embodiments may be made without departing from the scope and spirit of the present invention.

What is claimed is:

1. An umbrella comprising:

a shaft having a finishing cap on a first end thereof and a handle on a second end of said shaft, a plurality of ribs radially and pivotally connected to said finishing cap;

a sleeve slidably mounted to said shaft, a stop extending radially outward from a first end of said sleeve, a first flange and a second flange respectively extending radially outward from said sleeve, said first flange located between said stop and said second flange, a collar movably mounted to said sleeve and located between said stop and said first flange, a plurality of first stretchers pivotally connected between said collar and said ribs, a runner movably mounted to said sleeve and located between said first flange and said second flange, a plurality of second stretchers pivotally connected between said runner and said ribs.

2. The umbrella as claimed in claim 1 further comprising a plurality of resilient members connected between said runner and said ribs.

3. The umbrella as claimed in claim 1, wherein a distance between said first flange and said second flange is larger than a distance between said first flange and said stop.

4. The umbrella as claimed in claim 1 further comprising an actuator connected to a second end of said sleeve.

5. The umbrella as claimed in claim 1 further comprising a positioning cap connected to said first end of said sleeve and said positioning cap having an annular tongue portion which is located between said sleeve and said shaft.

* * * * *